United States Patent [19]

Thaler et al.

[11] Patent Number: 4,604,514

[45] Date of Patent: Aug. 5, 1986

[54] ELECTRIC CURLING IRON WITH SELECTIVELY LOCKABLE ROTATABLE HANDLES

[75] Inventors: Arnold Thaler, Plantation, Fla.; Lai Kin, Kowloon, Hong Kong

[73] Assignee: Windmere Corporation, Hialeah, Fla.

[21] Appl. No.: 610,567

[22] Filed: May 15, 1984

[51] Int. Cl.[4] ..... H05B 3/00; A45D 1/04; A45D 1/18

[52] U.S. Cl. ..... 219/225; 132/34 R; 132/37 R; 219/230; 219/533

[58] Field of Search ..... 219/222-226, 219/533, 230, 228; 132/37 R, 37 A, 31 R, 32 R, 118; 137/34 R, 7, 9

[56] References Cited

U.S. PATENT DOCUMENTS

| | | | |
|---|---|---|---|
| 1,491,981 | 4/1924 | Brinkman | 132/37 |
| 1,622,834 | 3/1927 | Marcel | 132/37 |
| 1,630,078 | 5/1927 | Smith | 219/225 X |
| 2,550,295 | 4/1951 | Price | 132/37 R |
| 3,516,420 | 6/1970 | Porter | 132/7 |
| 3,731,694 | 5/1973 | Moro | 132/118 |
| 4,024,375 | 5/1977 | Olesen et al. | 219/225 |
| 4,163,143 | 7/1979 | Federico | 219/225 |
| 4,267,431 | 5/1981 | Rick et al. | 219/225 |
| 4,365,140 | 12/1982 | Bast et al. | 219/225 |
| 4,464,562 | 8/1984 | Takimae | 219/225 |

*Primary Examiner*—A. Bartis

*Attorney, Agent, or Firm*—Odin, Feldman & Pittleman

[57] ABSTRACT

An electric curling iron includes an electrically heated cylinder having an exterior surface around which hair is wrapped for applying heat to the hair being curled and a partial cylindrical clamp member pivotally movable toward and away from the cylinder for clamping the hair against the cylinder. Rotation of the curling iron during use is facilitated by a main handle and clamp handle coupled to the heated cylinder and clamp member, respectively. The main handle and clamp handle are elongated members grippable in one hand of the user of the iron and are freely rotatable relative to the cylinder and clamp member so as to enable the cylinder and clamp member to be rotated within the hand of the user while hair is clamped between the clamp member and cylinder. The main and clamp handle are each provided with a locking mechanism selectively movable between a first position locking the respective handles against rotation and a second position wherein the respective handles are free to rotate. The locking mechanisms are each spring biased to the first position and are provided with a retaining element for releasably retaining the locking mechanism in its second position when moved into the second position.

25 Claims, 13 Drawing Figures

ELECTRIC CURLING IRON WITH SELECTIVELY LOCKABLE ROTATABLE HANDLES

BACKGROUND OF THE INVENTION

The present invention involves a rotatable curling iron.

Numerous different styles of curling irons have been available and utilized for many years. In the operation all such curling irons, the end of the hair is clamped between a heated cylindrical barrel and a clamp member which is contoured so as to partially wrap around the heated cylindrical barrel. The hair is then wrapped up around the heated cylinder and clamp member for applying heat to the wrapped hair so as to form a curl or wave within the hair. Once the curl is formed after sufficient heat applied, the hair is unwrapped from around the heated cylinder and clamp member. This wrapping and unwrapping operation, however, is often difficult to manipulate since the curling iron is operated with merely holding it in a single hand of the user and it is, therefore, necessary for the user to turn the curling iron with the use of only a single hand.

Exemplary of such prior art curling irons are those curling irons shown in U.S. Pat. Nos. 4,163,143 to Federico et al. and 4,365,140 to Bast et al. In addition to the curling iron shown in these patents, in several curling irons the arm for controlling the movement of the clamp is elongated so as to extend substantially the same length as the main handle attached to the heated cylinder. In this second type of arrangement, the clamp member is not spring biased towards the heated cylinder but the clamp member is operated by manipulation of the elongated arm attached to the clamp member. This type of arrangement is referred to as a Marcel grip curling iron.

In all of these previous curling irons, however, the handles, both the main handle attached to the heated cylinder and the handle attached to the clamp are fixed relative to the heated cylinder and clamp member, respectively.

In order to facilitate the manipulation of a hair curling brush, various embodiments have been developed for enabling hair to be curled around a brush member and then either the barrel with the teeth are rotated relative to the handle for enabling the hair to be readily unwrapped from the brush member by rotation of the barrel or alternatively the teeth are rotated and drawn into an inter chamber within the brush member so that the barrel can be slid out of the curl. Exemplary of this latter type of embodiment is the retractable curling brush disclosed in commonly assigned U.S. Pat. No. 4,473,086.

SUMMARY OF THE INVENTION

An object of the present invention is to provide an improved curling iron constructed for facilitating rapid utilization and easy manipulation of the curling iron.

Another object of the present invention is to provide an improved curling iron constructed for facilitating rapid wrapping and unwrapping of the hair around the heated cylinder and clamp member of the curling iron.

A further object of the present invention is to provide a rotatable curling iron in which the hair can be rapidly wrapped around the heated cylinder and clamp member and unwrapped from such members by rotational movement of the curling iron within the hand of the user.

A still further object of the present invention is to provide a rotatable curling iron in which operation of the curling iron is facilitated by rotation of the main handle and clamp handle which are coupled to the heated cylinder and clamp member, respectively.

These objectives are achieved with the utilization of the rotatable curling iron of the present invention. This curling iron includes a heat conductive cylinder having an exterior surface around which the hair is wrapped for applying heat to the hair. A main handle is coupled to the cylinder. This main handle is rotatable relative to the cylinder. A cylindrical clamp member is contoured so that its inner surface wraps around a portion of the outer surface of the heated cylinder for clamping the hair between the cylinder and the clamp member. During utilization of the curling iron, the end of the hair is clamped between the clamping member and the heated cylinder and then the hair is wrapped around the outer surface of the clamp member and the heated cylinder. A clamp handle for enabling pivotable operation of the clamp member is coupled to the clamp member. The clamp member is pivoted towards and away from the heated cylinder for grasping and releasing the hair, respectively, between the clamp member and the cylinder.

In addition to the main handle coupled to the cylinder being rotatable, the clamp handle also is rotatable relative to the clamp member. Both the main handle and clamp handle is accordance with the preferred embodiment of the present invention are elongated members that can be gripped within one hand of a user of the curling iron. The main handle and the clamp handle are rotatable so as to enable the cylinder and clamp member to be rotated within the hand of the user while the hair is clamped between the clamp member and the cylinder.

A main handle is mounted around an inner barrel which is coupled to the cylinder. The main handle is an outer sleeve which is rotatably arranged on such inner barrel for being rotatable with respect to the cylinder. Similarly, the clamp handle is an outer sleeve that is rotatably positioned on an inner clamp barrel which in turn is coupled to the clamp member.

A first locking mechanism serves to lock the main handle to the main inner barrel in a locked position for preventing rotation of such main handle. This first locking mechanism includes a lock member that is movable between a first position for locking the main handle and a second position for uncoupling the main handle from the main inner barrel so that the main handle is free to rotate relative to the main inner barrel and the cylinder.

A second locking mechanism is provided for locking the clamp handle to the clamp inner barrel for preventing rotation of the clamp handle. This second locking mechanism includes a locking member that is movable between a first position in which the clamp handle is locked to the clamp inner barrel and a second position for uncoupling the clamp handle from the clamp inner barrel so that the clamp handle is free to rotate relative to the clamp inner barrel and the clamp member.

The locking member of the first locking mechanism is spring biased towards its first position and similarly the locking member of the second locking mechanism is spring biased towards its first position so that both the main handle and the clamp handle are normally prevented from rotating relative to their respective inner barrels and the cylinder and clamp member, respectively. The locking mechanisms, both include retaining members for releasably retaining the locking members in their respective second positions once they are moved into such second positions.

DESCRIPTION OF THE PREFERRED EMBODIMENT

Figure 1:
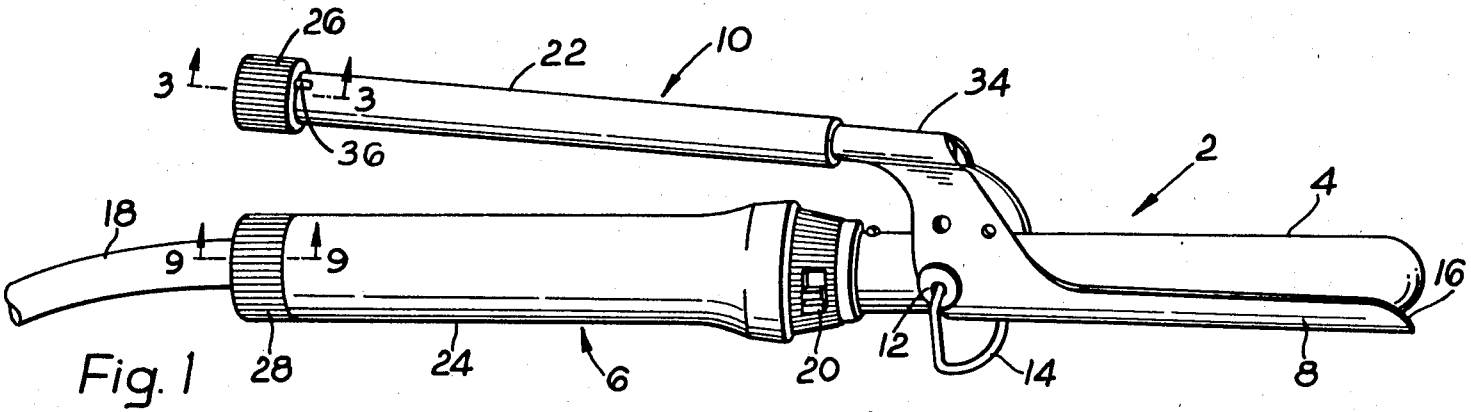
FIG. 1 is a side elevational view of the preferred embodiment of the rotatable curling iron of the present invention with the locking members in their first positions.
Figure 2:
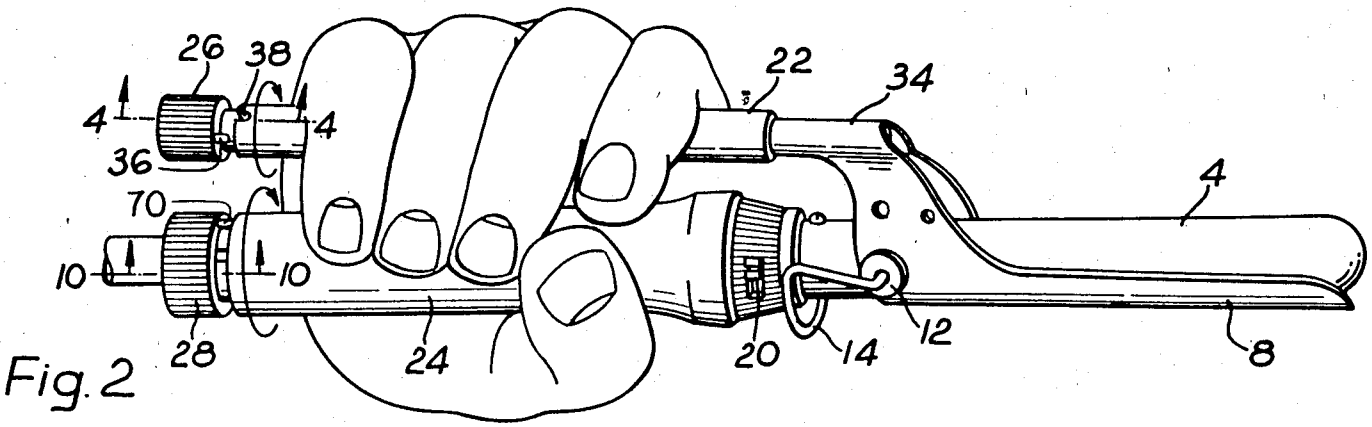
FIG. 2 is the same side elevational view of the rotatable curling iron shown in FIG. 1 except that the locking members are in their second positions for enabling rotation of the main handle and clamp handle in a hand of a user which hand is wrapped around such handles.
Figure 11:
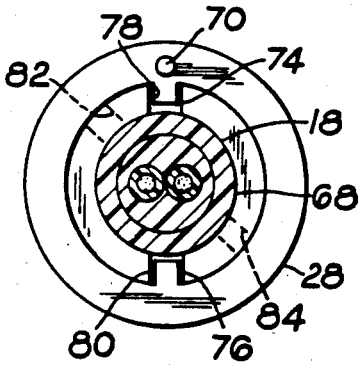
FIG. 11 is an end view of the locking mechanism taken along lines 11—11 in FIG. 9.
Figure 12:
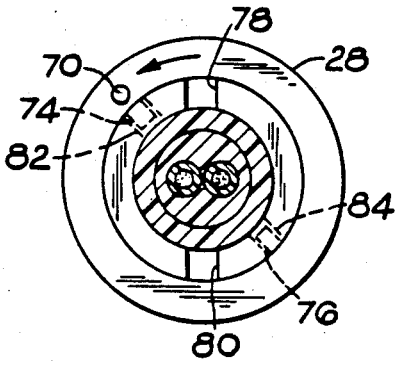
FIG. 12 is an end view of the locking mechanism taken along lines 12—12 in FIG. 10.

A rotatable curling iron 2 is illustrated in FIG. 1. This curling iron includes a cylindrical barrel 4 which is coupled to a main handle section 6. Cylindrical barrel 4 is heated by a set of electrical resistance wires which are supplied with electricity through electric cable 18. The cable 18 extends through the interior of sleeve 68 as shown in FIGS. 11 and 12. A clamp member 8 is contoured so as to partially wrap around cylindrical barrel 4. Clamp member 8 is coupled to a clamp handle section 10, such as shown in FIGS. 1 and 2.

Clamp member 8 can be pivoted by movement of clamp handle section 10 about a pivot point 12. The clamp member is coupled to the cylindrical barrel 4 by the ends of a wire rod 14 which passes through pivot points 12. The ends of wire rod 14 form the pivot axis for the clamp member.

Wire rod 14 also acts as a stand for the curling iron when it is in the extended position shown in FIG. 1. This wire rod stand can be pivoted into a retracted position shown in FIG. 2; during utilization of the curling iron, the wire rod stand would normally be rotated into this retracted position.

Electric current for heating the resistance wires inside of the heated conductive cylindrical barrel 4 is supplied by electrical cable 18. An on-off switch 20 is provided on a cylindrical member positioned between main handle section 6 and cylindrical barrel 4. This on-off switch also can be constructed for enabling selection of different temperature settings, e.g. the switch can be a three-position switch having an off position, a low heat position and a high heat position.

The main handle section 6 has a rotatable sleeve 24 which is capable of being rotated relative to cylindrical barrel 4. Clamp handle section 10 has an outer sleeve 22 which is capable of being rotated relative to clamp member 8. Outer sleeves 22 and 24 can be locked by locking members 26 and 28 against rotation such as shown in FIG. 1 or lock members 26 and 28 can be moved into a second position for releasing sleeves 22 and 24 thereby enabling such sleeves to rotate such as shown in FIG. 2.

Figure 3:
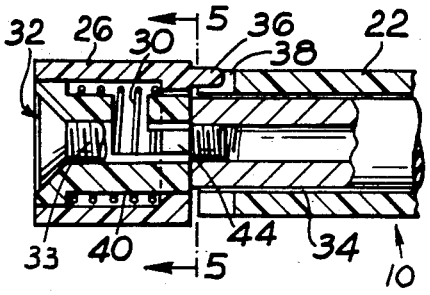
FIG. 3 is a sectional view of the locking mechanism of the clamp handle taken along lines 3—3 shown in FIG. 1.

FIGS. 3–8 illustrate the locking mechanism for locking sleeve 22 against rotation. As shown in FIG. 3, the locking member 26 is biased by a spring 30 into a first position for locking sleeve 22 against rotation. Sleeve 22 is arranged on the outside of a clamp inner barrel 34. Locking member 26 is coupled to inner barrel 34 through a screw 32. The shank 33 (see FIG. 7) is screwed into a threaded opening in inner barrel 34 (see FIGS. 3 and 4). Locking member 26 has a pin 36 extending from its end facing sleeve 22. In the first position of locking member 26, pin 36 extends into an opening 38 in the end of sleeve 22 for preventing rotation of such sleeve. In this locked position, sleeve 22 is coupled to inner barrel 34 through locking member 26 and is prevented from rotational movement with respect to the inner barrel and hence clamp member 8.

Figure 4:
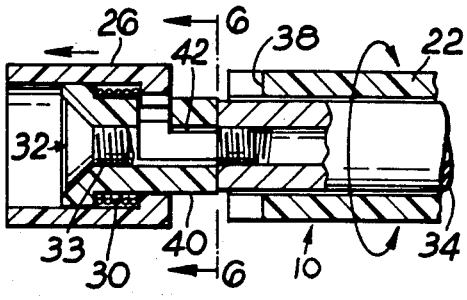
FIG. 4 is a sectional view of the locking mechanism of the clamp handle taken along lines 4—4 of FIG. 2.
Figure 5:
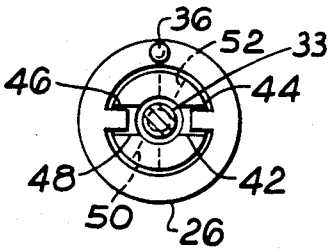
FIG. 5 is an end view of the locking mechanism taken along lines 5—5 in FIG. 3.
Figure 6:
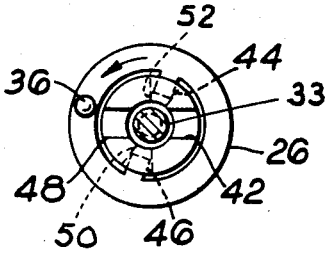
FIG. 6 is an end view of the locking mechanism taken along lines 6—6 in FIG. 4.
Figure 7:
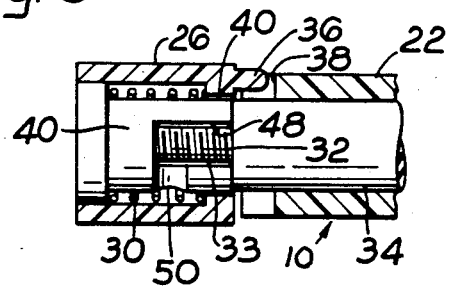
FIG. 7 is a partial sectional view of the locking mechanism shown in FIG. 3.

When rotation of sleeve 22 is to be allowed to occur, locking member 26 is withdrawn into a second position such as shown in FIG. 4 in which spring 30 is compressed. In this position, pin 36 is withdrawn from opening 38 thereby allowing sleeve 22 to freely rotate on inner barrel 34. As the locking member 26 is withdrawn, it moves longitudinally along a retainer sleeve 40. Screw 32 attachs this retainer sleeve 40 to the inner barrel 34. Thus, the longitudinal movement of locking member 26 compresses spring 30 as shown in FIG. 4.

Figure 8:
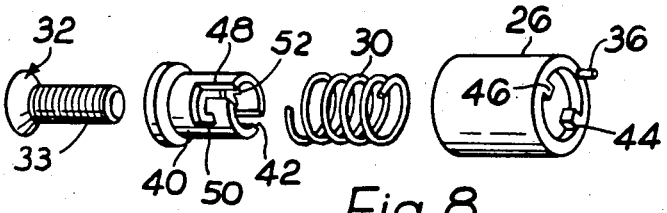
FIG. 8 is an exploded view of the locking mechanism shown in FIG. 3.

Locking member 26 has two lugs 44 and 46 such as shown in FIG. 8. These lugs slide within slots 42 and 48 as locking member 26 is longitudinally moved into its second position. After locking member 26 is moved into its second position, the locking member can be slightly rotated so that lugs 44 and 46 can enter slots 50 and 52. These slots 50 and 52, as shown in FIG. 8, only extend a short distance and do not allow locking member 26 to return to its first position in which pin 36 enters opening 38 in sleeve 22. Consequently, once lugs 44 and 46 enter slots 50 and 52, locking member 26 is retained in its second position. With the locking member 26 in its second position, sleeve 22 is now free to rotate abouts its inner barrel 34, relative to such inner barrel and clamp member 8. When sleeve 22 is to be locked again, locking member 26 is moved a short distance in its longitudinal direction for withdrawing lugs 44 and 46 from slots 50 and 52 and enabling the locking member to be rotated so that lugs 44 and 46 can enter into slots 42 and 48. Locking member 26 is now returned by the force of spring 30 to its first position in which pin 36 enters opening 38 for locking of sleeve 22.

Sleeve 24 of the main handle section 6 is locked against rotation by a locking member 28 when such locking member is in its first position as shown in FIG. 1. When locking member 28 is longitudinally moved into its second position such as shown in FIG. 2, sleeve 24 is then free to rotate. Sleeve 24 is arranged on an inner barrel 68. This inner barrel 68 is attached to cylindrical barrel 4. The electrical cable 18 containing the electrical wires is arranged within this inner barrel 68.

Figure 9:
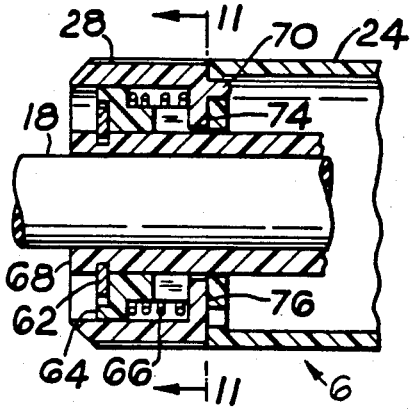
FIG. 9 is a sectional view of the locking mechanism taken along lines 9—9 in FIG. 1.

Locking member 28 has a pin 70 which slides into an opening 72 in sleeve 24 when the locking member is in its first position as shown in FIG. 9. Locking member 28 is biased into this open position by a spring 66. Locking member 28 is positioned on a retainer member 64 which in turn is connected to inner barrel 68 by a snap ring 62.

Figure 10:
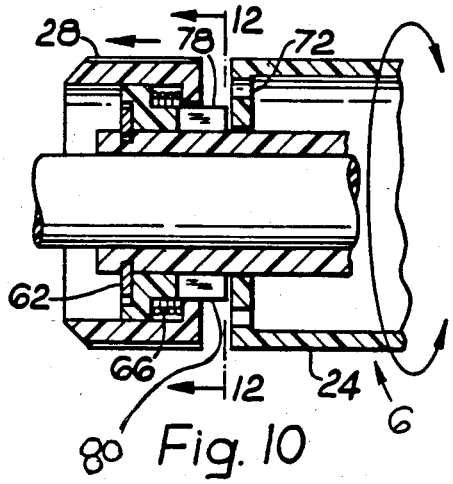
FIG. 10 is a sectional view of the locking mechanism taken along lines 10—10 in FIG. 2.
Figure 13:
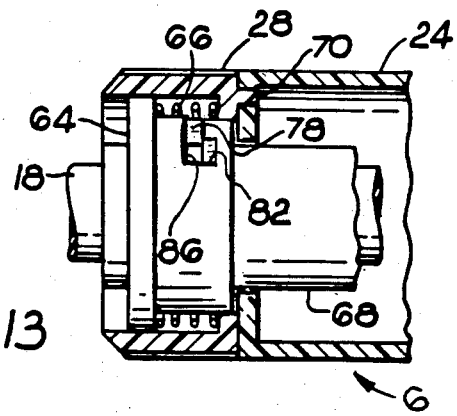
FIG. 13 is a partial sectional view of the locking mechanism shown in FIG. 9.

When sleeve 24 is to be free to rotate, locking member 28 is moved in a longitudinal direction so as to compress spring 66 and to move the locking member into its second position shown in FIG. 10. In this second position, pin 70 is withdrawn from opening 72 and sleeve 24 is free to rotate. Locking member 28 has two lugs 74 and 76 which fit within slots 78 and 80 when the locking member is in its first position such as shown in FIGS. 9, 11 and 13.

When the locking member is moved into its second position, however, the locking member is partially rotated so that lugs 74 and 76 are free to enter retaining slots 82 and 84. As locking member 28 is rotated, the lugs move through a lateral slot such as slot 86 interconnecting slot 78 and 82 as shown in FIG. 13. When lugs 74 and 76 enter retaining slots 82 and 84, the locking member is releasably secured in its second position so that pin 70 remains withdrawn from opening 72. A plurality of such openings 72 can be provided in the end of sleeve 24 so that if pin 70 enters any such openings, sleeve 24 is prevented from rotating.

As long as locking member 28 remains in its second position such as shown in FIGS. 10 and 12, sleeve 24 is free to rotate. When sleeve 24 is to be locked again so as to prevent rotation, locking member 28 is moved in a longitudinal direction for withdrawing lugs 74 and 76 from retaining slots 82 and 84 and locking member 28 is rotated back to its position for enabling the lugs to enter slots 78 and 80. The force of spring 66 now returns locking member 28 to its first position in which pin 70 re-enters opening 72.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A rotatable curling iron comprising:

a heat conductive cylinder having an outer surface;

a main handle coupled to said cylinder, said main handle being rotatable relative to said cylinder;

first locking means on said main handle and cylinder and movable between a first position for coupling and locking said main handle to said cylinder, in which position said main handle is prevented from rotating, and a second position for uncoupling said main handle from said cylinder, in which position said main handle is free to rotate relative to said cylinder, said first locking means being biased toward said first position, said first locking means including first retaining means releasably retaining said first locking means in its second position when moved into such second position;

clamping means having a partial cylindrical clamp member having inner and outer surfaces, said inner surface of said clamp member being contoured to wrap around a portion of the outer surface of said cylinder for clamping hair between said cylinder and said clamp member and a clamping handle coupled to said clamp member; and means for pivotably coupling said clamping means to said cylinder so that said clamp member can be pivoted with respect to said cylinder by manipulation of said clamping handle.

2. A rotatable curling iron according to claim 1 wherein said clamping handle is rotatable relative to said clamp member.

3. A rotatable curling iron according to claim 2 wherein said cylinder has a hollow center and further comprising a heating element disposed within said hollow center of said cylinder and electrical means capable of electrically activating said heating element when coupled to a source of electrical power.

4. A rotatable curling iron according to claim 3 wherein said main handle and said clamping handle are elongated members and are arranged so that they can be gripped within one hand of a user of said curling iron.

5. A rotatable curling iron according to claim 2 further comprising second locking means movable between a first position for coupling and locking said clamping handle to said clamp member in which position said clamping handle is prevented from rotating and a second position for uncoupling said clamping handle from said clamp member in which position said clamping handle is free to rotate relative said clamp member.

6. A rotatable curling iron according to claim 5 further comprising a main inner barrel coupled to said cylinder at one end thereof and wherein said main handle is an outer sleeve rotatably arranged on said main inner barrel for rotation relative to said cylinder.

7. A rotatable curling iron according to claim 6 wherein said clamping means further includes a clamp inner barrel coupled to said clamp member and wherein said clamping handle constitutes an outer sleeve rotatably positioned on said clamp inner barrel of said clamping means for rotation relative to said clamp inner barrel of said clamping means and said clamp member.

8. A rotatable curling iron according to claim 7 wherein said first locking means is movable between said first position for coupling and locking said main handle to said main inner barrel, in which position said main handle is prevented from rotating, and said second position for uncoupling said main handle from said main inner barrel, in which position said main handle is free to rotate relative to said main inner barrel and said cylinder.

9. A rotatable curling iron according to claim 8 wherein said second locking means is movable between said first position for coupling and locking said clamping handle to said clamp inner barrel of said clamping means, in which position said clamping handle is prevented from rotating, and said second position for uncoupling said clamping handle from said clamp inner barrel of said clamping means, in which position said clamping handle is free to rotate relative to said clamp inner barrel of said clamping means and said clamp member.

10. A rotatable curling iron according to claim 9 wherein said first locking means is spring biased towards its first position.

11. A rotatable curling iron according to claim 10 wherein said second locking means is spring biased towards its first position.

12. A rotatable curling iron according to claim 11 wherein said second locking means includes second retaining means releasably retaining said second locking means in its second position when moved into such second position.

13. A rotatable curling iron according to claim 12 wherein said cylinder has a hollow center and further comprising a heating element disposed within said hollow center of said cylinder and electrical means capable of electrically activating said heating element when coupled to a source of electrical power.

14. A rotatable curling iron according to claim 13 wherein said main handle and said clamping handle are elongated members that can be gripped within one hand of a user of said curling iron.

15. A rotatable curling iron according to claim 14 wherein said main handle and said clamp handle are rotatable so as to enable said cylinder and said clamp member to be rotated within the hand of a user while hair is clamped between said clamp member and said cylinder.

16. A rotatable curling iron comprising:

a heat conductive cylinder having an outer surface;

a main handle coupled to said cylinder, said main handle being rotatable relative to said cylinder;

clamping means having a partial cylindrical clamp member having inner and outer surfaces, said inner surface of said clamp member being contoured to wrap around a portion of the outer surface of said cylinder for clamping hair between said cylinder and said clamp member and a clamping handle coupled to said clamp member, said clamping handle being rotatable relative to said clamp member;

first locking means on said main handle and cylinder movable between a first position for coupling and locking said main handle to said cylinder, in which position said main handle is prevented from rotating, and a second position for uncoupling said main handle from said cylinder, in which position said main handle is free to rotate relative to said cylinder, said first locking means being spring biased towards its first position; and said main handle and said clamping handle being elongated members that can be gripped within one hand of a user of said curling iron and said main handle and said clamp handle being rotatable so as to enable said cylinder and said clamp member to be rotated within the hand of a user while hair is clamped between said clamp member and said cylinder.

17. A rotatable curling iron according to claim 16 wherein said cylinder has a hollow center and further comprising a heating element disposed within said hollow center of said cylinder and electrical means capable of electrically activating said heating element when coupled to a source of electrical power.

18. A rotatable curling iron according to claim 16 further comprising a main inner barrel coupled to said cylinder at one end thereof and wherein said main handle is an outer sleeve rotatably arranged on said main inner barrel for rotation relative to said cylinder.

19. A rotatable curling iron according to claim 18 wherein said first locking means is movable between said first position for coupling and locking said main handle to said main inner barrel, in which position said main handle is prevented from rotating, and said second position for uncoupling said main handle from said main inner barrel, in which position said main handle is free to rotate relative to said main inner barrel and said cylinder.

20. A rotatable curling iron according to claim 16 wherein said clamping means further includes a clamp inner barrel coupled to said clamp member and wherein said clamping handle constitutes an outer sleeve rotatably positioned on said clamp inner barrel of said clamping means for rotation relative to said clamp inner barrel of said clamping means and said clamp member.

21. A rotatable curling iron according to claim 20 further comprising second locking means movable between a first position for coupling and locking said clamping handle to said clamp inner barrel of said clamping means, in which said clamping handle is prevented from rotating, and a second position for uncoupling said clamping handle from said clamp inner barrel of said clamping means, in which position said clamping handle is free to rotate relative to said clamp inner barrel of said clamping means and said clamp member.

22. A rotatable curling iron according to claim 21 wherein said second locking means is spring biased towards its first position.

23. A rotatable curling iron according to claim 22 wherein said second locking means includes second retaining means releasably retaining said second locking means in its second position when moved into such second position.

24. A rotatable curling iron according to claim 7 wherein said first locking means includes first retaining means releasably retaining said first locking means in its second position when moved into such second position.

25. A rotatable curling iron according to claim 16 further comprising second locking means movable between a first position for coupling and locking said clamping handle to said clamp member of said clamping means, in which position said clamping handle is prevented from rotating, and a second position for uncoupling said clamping handle from said clamp member of said clamping means, in which position said clamping handle is free to rotate relative to said clamp member.

* * * * *